United States Patent [19]

Newkirk

[11] 4,432,462

[45] Feb. 21, 1984

[54] RECEPTACLE TAMPERING INDICATOR AND METHOD THEREFOR

[76] Inventor: Randall A. Newkirk, 22700 Lake Forest, #411, El Toro, Calif. 92630

[21] Appl. No.: 435,017

[22] Filed: Oct. 18, 1982

[51] Int. Cl.[3] ..... B65D 55/02

[52] U.S. Cl. ..... 215/365; 53/420; 116/201; 116/266; 206/459; 206/807; 215/230

[58] Field of Search ..... 53/420; 215/365, 366, 215/230; 116/200, 201, 264, 266, 307; 206/807, 459

[56] References Cited

U.S. PATENT DOCUMENTS

| | | | |
|---|---|---|---|
| 986,270 | 3/1911 | Daniels | 215/365 |
| 1,055,595 | 3/1913 | Atkins | 215/365 |
| 1,843,234 | 2/1932 | Karnes et al. | 116/201 X |

*Primary Examiner*—Donald F. Norton
*Attorney, Agent, or Firm*—Fischer, Tachner & Strauss

[57] ABSTRACT

A reliable and low cost indicator to be associated with a receptacle filled with dosage forms (e.g. over-the-counter drugs) and a corresponding method by which to quickly and easily warn a consumer that an unauthorized tampering may have occurred to the receptacle and the contents thereof. The tampering indicator is preferably either attached to or integrally formed with a seal at the underside of a removable receptacle cap. The tampering indicator comprises a fluid filled reservoir, a tab having a chemically treated indicator strip thereat, and a fluid path by which fluid from the reservoir communicates with the indicator strip. The indicator is engaged by the rim of the receptacle when the cap is positioned thereover by the dosage form manufacturer. Accordingly, fluid is forced from the reservoir into the fluid path. However, the fluid path is initially blocked at the engagement thereof by the receptacle rim. The tab and the indicator strip thereof extend outwardly from beneath the cap of the receptacle for providing the consumer with a visual indication in the event of an unauthorized removal of the cap from the receptacle. That is, should the cap be removed from the receptacle and the fluid path be moved out of engagement with the receptacle rim prior to a purchase by a consumer, whereupon tampering with the contents of the receptacle might occur, fluid from the supply thereof is permitted to flow via the fluid path to the chemically treated strip, whereby to cause the strip to assume a characteristic color that is indicative of a possible tampering condition.

20 Claims, 5 Drawing Figures

RECEPTACLE TAMPERING INDICATOR AND METHOD THEREFOR

BACKGROUND OF THE INVENTION

1. Field of the Invention

This invention relates to a reliable and low cost tampering indicator that is interfaced with the cap of an over-the-counter drug filled receptacle and is adapted to provide either a merchant or a consumer with a visible warning in the event of an unauthorized removal of the receptacle cap prior to the purchase of the receptacle by the consumer.

2. Prior Art

The number of over-the-counter drugs being dispensed by drug and grocery stores, and the like, is steadily increasing year after year. Many of these drugs are adapted to be taken internally by the consumer. Accordingly, attempts have been made to provide means by which to prevent tampering with the receptacle and the contents thereof, whereby to minimize the risk of a consumer ingesting an intentionally tainted dosage form. With certain dosage forms, such as, for example, that consisting of a pair of detachable capsule halves having an active ingredient added therewithin, the consumer is especially susceptible to harm should an unauthorized individual tamper with the active ingredient. That is, without suitable means to prevent or to indicate a tampering with a drug receptacle, the consumer may have no viable way to protect himself against such unauthorized tampering and the return to the self of a tainted dosage supply for subsequent purchase by an unsuspecting consumer. As a result of the foregoing, federal and local legislation may soon be enacted whereupon to require a tamper resistant receptacle for almost all over-the-counter drugs and cosmetics.

Common examples of conventional means for attempting to tamper-proof a drug receptacle include surrounding the receptacle with a cellophane or clear plastic wrapping. Another attempt to prevent tampering with a drug receptacle includes the heat shrinking of a plastic collar around the mouth of the receptacle. Still another common means for preventing tampering with a drug receptacle includes the attachment of a foil or paper seal across the mouth of the receptacle below the receptacle top. Yet another well-known means for preventing tampering with a drug receptacle includes a well-known blister package, whereby to enclose one or more dosage forms within a transparent protective cover. A tear in or the removal of any of the above-identified tamper-proofing means would provide an indication to the consumer of the possible tampering with the drug receptacle or the contents thereof.

However, each of the aforementioned tamper-proofing means may be characterized by one or more shortcomings. For example, an outer cellophane wrapping might be completely removed and subsequently replaced with no knowledge thereof being conveyed to the unsuspecting consumer. A heat-shrinkable collar and a seal at the mouth of a receptacle are frequently difficult to remove, especially by the elderly. Although having relatively wide appeal, a blister package is relatively expensive to fabricate and is inefficient in terms of space consumption. Thus, it is desirable to provide a low cost and reliable means by which to reduce the risk of an unauthorized tampering with a drug receptacle without unduly restricting access to the contents thereof by a consumer.

SUMMARY OF THE INVENTION

It is a primary object of the present invention to provide a reliable and low cost tampering indicator to be associated with a drug filled receptacle by which to warn of a possible unauthorized tampering with either the receptacle or the contents thereof.

It is another object of this invention that the present tampering indicator be readily visible to both consumers and store merchants alike, so that an indication of tampering is quickly and easily available without the necessity of first opening or purchasing the drug receptacle.

It is an additional object of this invention that the present tampering indicator be either attached to or formed as an integral part of a seal that is located beneath a removable receptacle cap, so that the indicator will be engaged by the rim of the drug receptacle when the cap is initially positioned thereover at the factory by the drug manufacturer in order to cause a closure of the receptacle.

It is yet an additional object of this invention that the present indicator be adapted to provide a visible warning to the consumer in the event that the cap has been removed from the drug receptacle so as to cause the tampering indicator to be disengaged from the receptacle rim prior to a purchase of the receptacle by a consumer.

It is a further object of this invention that the present tampering indicator include a tab which projects outwardly from beneath the cap of the drug receptacle, which tab includes a chemically treated indicator strip so as to supply the visible warning of possible tampering to the consumer.

It is still a further object of this invention that the present tampering indicator include a fluid reservoir supply that is conveyed to the chemically treated indicator strip to thereby cause the strip to assume a characteristic color, so that the visible warning can be given to the consumer in the event that the cap has been removed from the drug receptacle prior to purchase of the receptacle by the consumer.

Further objects and advantages of this invention will become apparent as the following description proceeds and the features of novelty which characterize this invention are pointed out with particularity in the claims which are annexed hereto.

DESCRIPTION OF THE PREFERRED EMBODIMENT

Figure 2:
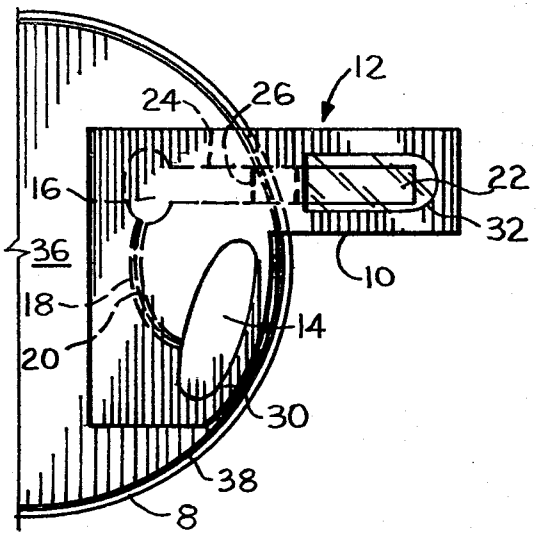
FIG. 2 shows the underside of the receptacle cap with the tampering indicator of the present invention attached thereat.
Figure 3:
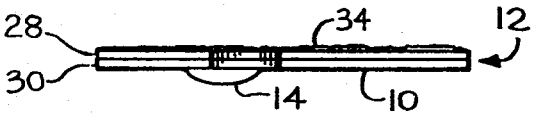
FIG. 3 is a side view of the tampering indicator of FIG. 2.
Figure 1:
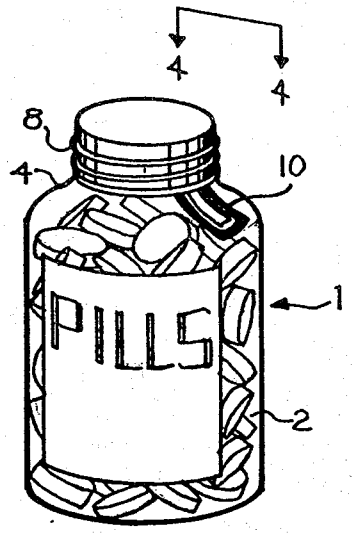
FIG. 1 shows a drug filled receptacle having the tampering indicator of the present invention including a tab which extends outwardly from beneath the cap of the receptacle for providing a visible warning to a consumer of possible tampering with the receptacle cap and the contents of the receptacle.

Referring now to the drawings, FIG. 1 shows a conventional receptacle 1, such as that known to contain a plurality of dosage forms 2. By way of example, receptacle 1 may be a bottle in which an assortment of food stuffs or over-the-counter tablets, capsules, or pills are contained for purposes of storage and transport. Receptacle 1 includes an opened mouth 4 having a rim (not shown) therearound through which dosage forms 2 may be either loaded within or removed from the receptacle. The mouth of receptacle 1 is closed at the rim thereof by a conventional and readily available closure means, such as a cap 8. Extending from beneath cap 8 is an elongated tab portion 10. As is best illustrated in FIGS. 2 and 3 and as will be disclosed when referring thereto, tab portion 10 is an integral part of the receptacle tampering indicator which forms the present invention. As will also be disclosed in greater detail hereinafter, tab portion 10 includes a means by which to provide either a consumer or a store merchant with a visible warning in the event of an unauthorized tampering with the cap 8 of receptacle 1 prior to the purchase thereof by the consumer.

The receptacle tampering indicator 12 of the present invention is described in detail while referring concurrently to FIGS. 2 and 3 of the drawings. Indicator 12 comprises a primary fluid reservoir 14. Primary reservoir 14 is filled with a readily available fluid such as a gas or liquid (e.g. water, lightweight oil, or carbon dioxide gas). In a preferred embodiment of the invention, primary reservoir 14 is filled with water, whereby to minimize cost and facilitate the manufacturing process thereof. An additive, such as antifreeze, may be added to reservoir 14, so as to prevent the fluid thereof from being easily frozen. Accordingly, and as will soon become apparent, the aforementioned additive will reduce the opportunity for an unauthorized individual to defeat the intended operation of the present indicator 12.

Indicator 12 also includes a secondary fluid reservoir 16. Secondary reservoir 16 is initially devoid of any fluid. Primary and secondary fluid reservoirs 14 and 16 communicate with one another by way of a partially obstructed fluid path 18. That is, fluid path 18 includes means by which to control the rate of fluid flow from primary reservoir 14 to secondary reservoir 16. More particularly, fluid path 18 may include a string 20. The purpose of string 20 is to delay the communication of fluid from primary reservoir 14 to secondary reservoir 16 for a sufficient time to permit the cap 8 to be secured to the receptacle by the dosage form manufacturer. By way of particular example, string 20 is preferably formed from a synthetic (e.g. nylon) material, so as to minimize the fluid that might be absorbed by string 20 from the supply thereof at primary reservoir 14.

Indicator 12 includes an elongated tab portion 10 which, as previously disclosed when referring to FIG. 1, extends outwardly from beneath the cap 8 of the dosage form receptacle, so as to provide a visible warning in the event of an unauthorized tampering with cap 8 prior to a purchase of the receptacle by a consumer. More particularly, the tab portion 10 of indicator 12 includes thereon a fluid indicator 22. By way of a preferred embodiment of the present invention, fluid indicator 22 is a chemically treated strip of paper, such as that known in the art as litmus paper. As will be known to those skilled in the art, and in general terms, litmus paper is a chemically treated sheet which is adapted to turn a characteristic color in the presence of either an acid or alkali material. Therefore, the particular litmus paper indicator strip 22 to be used for the presently disclosed tampering indicator 12 is selected so as to be responsive to and provide a visible indication of the presence of fluid, such as that fluid which is to be conveyed to litmus paper strip 22 from primary fluid reservoir 14.

Secondary fluid reservoir 16 communicates with indicator strip 22 by way of an additional fluid path 24. Thus, and as will be disclosed in greater detail hereinafter, fluid may be conveyed from primary reservoir 14 to indicator strip 22 via a fluid passageway comprising fluid path 18, secondary reservoir 16, and fluid path 24. A crease 26 may be formed through additional fluid path 24, so as to permit tab portion 10 to be bent across fluid path 24 in order to permit the present receptacle tampering indicator 12 to be extended outwardly from beneath the receptacle cap 8, so as to be easily viewed by either a consumer or a store merchant. Crease 26 may also serve as a pressure seal, whereby to temporarily prevent the communication of fluid between secondary reservoir 16 and indicator strip 22. The presence of sufficient pressure in fluid path 24 will be suitable to break the pressure seal at crease 26 and thereby permit the communication of fluid therepast to strip 22.

As is best shown in FIG. 3, receptacle tampering indicator 12 comprises top and bottom halves 28 and 30. Each half of indicator 12 is preferably fabricated from a thin and opaque, heat and/or pressure sensitive material, such as a plastic, a foil, or the like. Primary fluid reservoir 14 is stamped or pressed into the bottom half 30 of indicator 12. Thus, primary reservoir 14 extends downwardly from bottom half 30 so as to be able to receive a suitable supply of fluid (e.g. water). Top and bottom indicator halves 28 and 30 are sealed together by means of a controlled application of heat and pressure thereto. However, prior to sealing, a strip of litmus paper 22 is positioned at the tab portion 10 of indicator 12 between the top and bottom halves 28 and 30 thereof. Moreover, a suitably sized portion of string 20 is positioned along the bottom half 30 of indicator 12 so as to define a region at which fluid path 18 will be formed between primary and secondary fluid reservoirs 14 and 16. During the manufacturing and sealing process by which the receptacle tampering indicator 12 is formed, dies can be utilized, so that voids will be created in the seal between top and bottom indicator halves 28 and 30. These voids (not shown) are suitably shaped and dimensioned so as to define secondary fluid reservoir 16 and fluid paths 18 and 24 at the interface between indicator halves 28 and 30. The fluid passageway including reservoirs 14 and 16 and paths 18 and 24 forms a closed system to prevent the escape of fluid therefrom.

As is best shown in FIG. 2, the tab portion 10 of tampering indicator 12 includes a window member 32 formed therethrough Window member 32 is positioned at tab portion 10 so as to be in alignment with indicator strip 22. During the manufacturing and sealing process, pieces of transparent (e.g. plastic) covering material are positioned over the top and bottom of indicator strip 22, so that when indicator halves 28 and 30 are sealed together, the color of indicator strip 22 will be visible to the consumer or store merchant through window member 32. In the alternative, the top half 28 of indicator 12 may be fabricated from a transparent material, so that indicator strip 22 is visible therethrough. Hence, the need for window member 32 and the transparent covering thereover would be advantageously eliminated.

When in the assembled relationship, the receptacle tampering indicator 12 of the present invention is positioned beneath the cap 8 of the receptacle in which a plurality of dosage forms are packaged by the manufacturer thereof. According to the first preferred embodiment of the present invention, a thin layer 34 of adhesive is disposed along the top indicator half 30. Accordingly, by applying suitable pressure, the manufacturer of the dosage forms may affix indicator 12 to the underside 38 of a receptacle cap 8 at a (e.g. paper or plastic) seal 36 that is frequently attached thereat. In the event that receptacle cap 8 does not have such a seal 36 associated therewith, receptacle tampering indicator 12 may be affixed directly to the underside 38 of receptacle cap 8. In a second preferred embodiment of the present invention, the seal 36 may include indicator 12 as an integral part thereof. Thus, the need to fabricate a separate seal 36 and receptacle tampering indicator 12 is eliminated by forming seal 36 with fluid reservoirs 14 and 16, fluid paths 18 and 24, and chemically treated fluid indicator strip 22 therein, as previously disclosed. However, such an integral seal-indicator structure would also include a tab (such as that designated by reference numeral 10) extending outwardly therefrom on which fluid indicator strip 22 would be disposed. Of course, it is to be understood that the sizes of receptacle tampering indicator 12 and the reservoirs 14 and 16 thereof are dependent upon the corresponding size of seal 36 and the area available beneath the receptacle cap 8.

Figure 4:
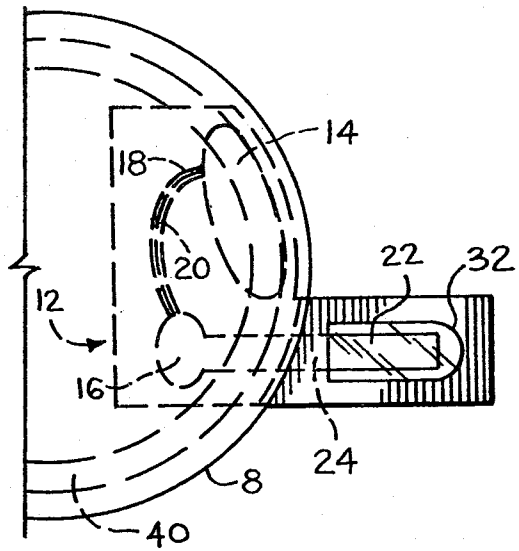
FIG. 4 shows the tampering indicator of the present invention positioned in the preferred assembled relationship between the cap and rim of the receptacle, as viewed along the lines 4—4 of FIG. 1.

The operation of the presently disclosed receptacle tampering indicator 12 is best disclosed while referring to FIG. 4 of the drawings. As previously disclosed, indicator 12 is attached beneath the receptacle cap 8. In accordance with the present invention, the primary fluid reservoir 14 and the additional fluid path 24 are particularly located so as to be engaged by the rim 40 which is formed at the mouth of the receptacle (designated 1 in FIG. 1), through which a supply of dosage forms may be withdrawn from or loaded within the receptacle. More particularly, when the manufacturer has loaded receptacle 1 with a suitable supply of dosage forms, a cap 8 containing receptacle tampering indicator 12 affixed at the underside thereof is placed over rim 40 so as to form a closure of the receptacle. Accordingly, the engagement of primary fluid reservoir 14 by the rim 40 of receptacle 1 compresses the reservoir 14 and increases the pressure on the fluid therein. The increased pressure being exerted at reservoir 14 by rim 40 forces a supply of fluid into the fluid path 18. Hence, the fluid is conveyed through fluid path 18 and along string 20 to secondary fluid reservoir 16. Fluid under pressure is then conveyed from secondary reservoir 16 into additional fluid path 24. However, fluid within path 24 is initially blocked from communication with fluid indicator strip 22, inasmuch as the receptacle rim 40 intersects fluid path 24. The resulting constriction in fluid path 24 interrupts the flow of fluid therethrough. Accordingly, the color of the fluid responsive indicator (litmus paper) strip will be unchanged. Thus, the dosage form receptacle and tampering indicator are in a condition that is suitable for distribution to drug stores or other markets where over-the-counter drugs are sold.

In the event that receptacle cap 8 is removed or loosened, the constriction that has heretofor been created in fluid path 24 by receptacle rim 40, whereby to block the flow of fluid therethrough, is removed. That is, the rim 40 of receptacle 1 no longer engages and intersects fluid path 24. Accordingly, fluid path 24 is no longer blocked, whereupon fluid is forced from secondary fluid reservoir 16 to indicator strip 22. When a drop of the fluid is received at fluid indicator (litmus paper) strip 22, strip 22 assumes a characteristic color so as to provide an indication of the communication of fluid between primary reservoir 14 and indicator strip 22. The color of strip 22 may be easily observed through the transparent material across window 32 at tab portion 10. Since fluid is not conveyed from secondary reservoir 16 to indicator strip 22 until after the removal of receptacle cap 8 from rim 40, a change in the color of strip 22 will provide a consumer or merchant with a visible warning that receptacle cap 8 has been removed. Should the visible warning be observed at strip 22 prior to the purchase of receptacle 1, a consumer will be provided with an indication of possible tampering with the cap 8 (and contents of) receptacle 1. As will be known to those skilled in the art, any small amount of fluid at paper strip 22 will cause a visible color change thereover, because the fluid will be conveyed along strip 22 by means of capillary action. Therefore, even if receptacle cap 8 is removed for a relatively short amount of time, a correspondingly small amount of fluid that is conveyed from secondary reservoir 16 to paper strip 22 will be sufficient to cause a change in color at strip 22 and, accordingly, provide a visible warning to a consumer or merchant of possible tampering.

Figure 5:
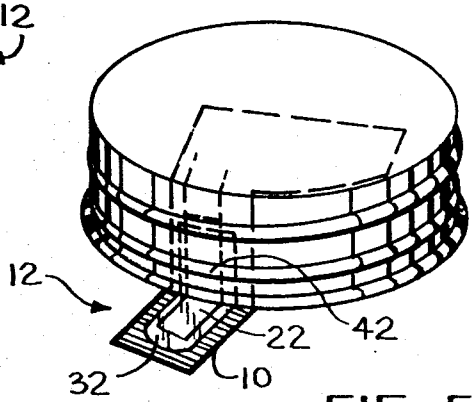
FIG. 5 illustrates the alignment of the present tampering indicator with screw threads formed in the receptacle cap.

As is shown in FIG. 5 of the drawings, fluid indicator strip 22 is of sufficient size, so that when the tab portion 10 thereof projects outwardly from beneath a receptacle cap 8 (i.e. with cap 8 attached to the rim of the receptacle), at least a portion of strip 22 extends upwardly into cap 8 beyond the screw threads 42 thereof (for a screw-on cap). Screw threads 42 prevent an unauthorized individual from defeating the intended operation of indicator 12 by inserting a crimping tool (not shown) between the rim 40 and cap 8 of receptacle 1 to thereby intentionally block the transmission of fluid to indicator strip 22 should the cap 8 be removed from receptacle 1. That is, inasmuch as only a small supply of fluid must be conveyed to a leading edge of strip 22 to cause a contamination thereof, an unauthorized individual will be unable to interrupt the fluid flow to the strip (and the corresponding visual warning produced thereby), because of the shield provided by the screw threads 42 which protrude from the interior of cap 8. Accordingly, should an attempt be made to force a tool into the cap 8 of receptacle 1 beyond the protruding screw threads 42, the cap and screw threads thereof will likely sustain damage which will also be indicative of tampering. In the event that receptacle cap 8 is without screw threads (such as in the case of a snap-on cap), the threads typically formed around the receptacle will perform the same function as do the aforementioned screw threads 42.

It might also be preferable for the manufacturer of the dosage forms to imprint its trademark, or the like, into either of the presently disclosed tampering indicator 22 or the seal 36 (best illustrated in FIG. 2) of cap 8 in the event that indicator 22 is formed as an integral part of seal 36. Thus, indicator 22 would bear a particular designation which would discourage the substitution of the indicator by an unauthorized individual who has attempted to tamper with the receptacle cap. Any other means of manufacturer identification (e.g. a particular material or color) might also be employed to further prevent a covert substitution of a new indicator 12 for one which has been contaminated due to tampering. More particularly, the transparent material across window member 32 might be decorated or contain written indicia to prevent an unauthorized interference therewith.

As can be readily appreciated, the receptacle tampering indicator 12 of the present invention can be manufactured without necessitating any change to the process or cost which has heretofore been utilized to manufacture the receptacle for dosage forms. An indicator 12 is merely secured (by means of adhesive layer 34) at the underside of the receptacle cap prior to the closing of the receptacle by the manufacturer. The present indicator 12 is relatively inexpensive to manufacture and provides both a merchant and consumer with a visible means by which to quickly and easily ascertain if a receptacle of dosage forms should be suspected of tampering. By virtue of tab portion 10 and window member 32, the visible warning is provided without requiring the receptacle to be taken home or opened, thus conserving time and minimizing possible consumer anxiety. Moreover, the dosage form manufacturer can be alerted, in the event that the receptacle is not properly sealed at the factory.

It will be apparent that while a preferred embodiment of the present invention has been shown and described, various modifications and changes may be made without departing from the true spirit and scope of the invention.

Having thus set forth a preferred embodiment of the present invention, what is claimed is:

1. An indicator to provide a warning of tampering with a receptacle, said indicator to be positioned between a cap for closing said receptacle and a rim of said receptacle through which the contents of the receptacle are loaded, said cap being removably connected to said receptacle at the rim thereof, and said tampering indicator comprising:

fluid supply means, fluid indication means responsive to and providing an indication of the presence of a fluid thereat, and fluid path means interconnecting said fluid supply means with said fluid indication means, said fluid supply means and said fluid path means being moved into engagement with the rim of said receptacle when the cap is connected thereto, so as to force fluid from said supply means into said path means, said fluid path means being blocked from communication with said indication means at the engagement of said path means by said receptacle rim, said fluid path means becoming unblocked to permit fluid to be conveyed to said fluid indication means in the event that the cap is removed from said receptacle and said fluid path means is disengaged from said receptacle rim.

2. The tampering indicator as recited in claim 1, further comprising an adhesive material thereof for securing said tampering indicator beneath said receptacle cap so that the fluid supply means and fluid path means are aligned with the rim of said receptacle so as to be engaged thereby when said cap is connected to said rim.

3. The tampering indicator recited in claim 1, wherein said indicator includes a tab having said fluid indication means positioned thereat, said tab extending outwardly from said cap to the exterior of said receptacle at which location an indication of the presence of a fluid is provided by said fluid indication means.

4. The tampering indicator recited in claim 1, wherein said receptacle cap includes a seal at the underside thereof, said tampering indicator being attached to said seal beneath said cap so that the fluid supply means and fluid path means are aligned with the rim of said receptacle so as to be engaged thereby when said cap is connected to said rim.

5. The tampering indicator recited in claim 1, wherein said fluid indication means includes a chemically treated member that is adapted to respond to the presence of a fluid thereat by assuming a particular characteristic color, said fluid indication means thereby providing a visual indication when said receptacle cap is removed from said receptacle rim.

6. The tampering indicator recited in claim 5, wherein said fluid indication means includes a strip of litmus paper.

7. The tampering indicator recited in claim 1, further comprising flow restricting means located within said fluid path means to control the rate at which fluid flows therethrough to said fluid indication means.

8. The tampering indicator recited in claim 7, wherein said flow restricting means includes a string.

9. An indicator to provide a warning in the event that a cap is removed from an associated receptacle, the cap being removably connected to said receptacle and said indicator comprising:

fluid supply means, fluid indication means responsive to and providing an indication of the presence of a fluid thereat, fluid path means interconnecting said fluid supply means with said fluid indication means, and means to block said fluid path means and thereby interrupt the flow of fluid to said indication means when the cap is connected to said receptacle and to unblock said fluid path means and thereby permit the flow of fluid to said indication means when the cap is removed from said receptacle.

10. The indicator recited in claim 9, wherein said receptacle includes a rim at which the cap thereof is removably connected and through which the contents of said receptacle are inserted or removed, said indicator being attached at the underside of the cap, so that when the cap is connected to said receptacle rim, the fluid supply means and fluid path means of said indicator are engaged by said rim so as to force fluid from said supply means into said path means, said fluid path means being blocked from communication with said indication means at the engagement of said path means by said receptacle rim, and said fluid path means becoming unblocked to permit fluid to be conveyed to said fluid indication means in the event that the cap is removed from said receptacle and said fluid path means is disengaged from said receptacle rim.

11. The indicator recited in claim 10, wherein said receptacle cap has a seal at the underside thereof, said indicator being attached to said seal beneath said cap.

12. The indicator recited in claim 10, said indicator further comprising a tab extending outwardly from a location beneath the receptacle cap to a location at the exterior of said receptacle, said tab having said fluid indication means situated thereon.

13. The indicator recited in claim 9, wherein said fluid indication means includes a chemically treated member that is adapted to respond to the presence of a fluid thereat by assuming a particular characteristic color, said fluid indication means thereby providing a visual indication when the receptacle cap is removed from said receptacle rim and fluid is supplied to said chemically treated member.

14. The indicator recited in claim 13, wherein said chemically treated member extends outwardly from said indicator from a location beneath the receptacle cap to a location at the exterior of said receptacle, so that the visual indication is provided by said chemically treated member at the exterior of said receptacle when the cap is removed therefrom.

15. The indicator recited in claim 13, wherein said chemically treated member includes a strip of litmus paper.

16. The indicator recited in claim 9, further comprising flow restricting means located within said fluid path means to limit the rate at which fluid flows therethrough to said fluid indication means.

17. The indicator recited in claim 16, wherein said flow restricting means includes a piece of string.

18. The indicator recited in claim 16, wherein said flow restricting means includes a constriction formed in said fluid path, said constriction being removed from said fluid path when fluid is supplied thereto under pressure.

19. The indicator recited in claim 9, wherein said fluid supply means includes a first reservoir filled with fluid, and said fluid path means includes therein a second reservoir which is to be filled with fluid that is supplied thereto from said first fluid filled reservoir, said second reservoir positioned between said first fluid filled reservoir and said fluid indication means.

20. A method for providing a warning at a fluid responsive indicator in the event that a cap is removed from an associated receptacle, said cap being removably connected to said receptacle, and said method comprising the steps of:

providing a fluid under pressure from a supply thereof to a fluid path, locating said fluid path between said fluid supply and said fluid responsive indicator, blocking the flow of fluid through said path and preventing the communication of the fluid thereof with said indicator when the cap is connected to said receptacle, unblocking the flow of fluid through said path and permitting the communication of the fluid thereof with said indicator when said cap is removed from said receptacle, and providing a warning at said fluid responsive indicator when fluid is supplied thereto from said fluid supply via said fluid path after the cap is removed from said receptacle.

* * * * *